US007179181B2

(12) United States Patent
Ko

(10) Patent No.: US 7,179,181 B2
(45) Date of Patent: Feb. 20, 2007

(54) ILLUMINATING BALL

(76) Inventor: Li-Lin Ko, No. 555, Sec. 2, Chang Nan Rd., Changhwa (TW)

( * ) Notice: Subject to any disclaimer, the term of this patent is extended or adjusted under 35 U.S.C. 154(b) by 0 days.

(21) Appl. No.: 11/183,897

(22) Filed: Jul. 19, 2005

(65) Prior Publication Data

US 2007/0021244 A1 Jan. 25, 2007

(51) Int. Cl.
*A63B 43/06* (2006.01)

(52) U.S. Cl. ..... 473/570

(58) Field of Classification Search ..... 473/570, 473/571, 603–605

See application file for complete search history.

(56) References Cited

U.S. PATENT DOCUMENTS 2,903,820 A * 9/1959 Cornell ..... 473/570
4,660,831 A * 4/1987 Kralik ..... 473/603
5,066,012 A * 11/1991 Stark ..... 473/570
5,236,383 A * 8/1993 Connelly ..... 473/570
5,609,411 A * 3/1997 Wang ..... 473/570
5,779,575 A * 7/1998 Hsieh ..... 473/570
5,888,156 A * 3/1999 Cmiel et al. ..... 473/570

* cited by examiner

*Primary Examiner*—Steven Wong
(74) *Attorney, Agent, or Firm*—Rabin & Berdo, P.C.

(57) ABSTRACT

An illuminating ball has embedded with a power supply device. Multiple output wires extending from the power supply device are electrically connected to multiple light emitting elements mounted over the ball. When the ball experiences vibration, a vibration-triggered switch in the power supply device can be automatically conducted to actuate the light emitting elements. On the contrary, the vibrating-triggered switch is automatically turned off if the ball is in the static status. Further, these light emitting elements also can be manually activated by controlling a switch.

6 Claims, 5 Drawing Sheets

ILLUMINATING BALL

BACKGROUND OF THE INVENTION

1. Field of the Invention

The invention relates to an illuminating ball, and more particularly to a ball embedded with multiple light emitting components that can be manually activated or automatically activated when the ball experiences vibration.

2. Related Art

Of all sports, ball games have long been the most popular, and include familiar forms for example, basketball, soccer, football and volleyball. Since current designs for these types of balls follow specific and standardized guidelines, the only room left for change seems limited to the material used and the surface patterns.

In addition to the formal sport competitions in which people enjoy these ball games, it is far more common for them to invite a few good friends to play a game or two together for recreation. However, their enjoyment is often limited by the dull and unexciting design of the conventional ball. To overcome this shortcoming, the present invention proposes a novel structure design of the ball, which will greatly enhance the pleasure of a recreational ball game.

SUMMARY OF THE INVENTION

An objective of the present invention is to increase the enjoyment of the ball game by providing an illuminating ball with multiple light emitting components, wherein the light emitting components can be manually activated, or automatically activated when the ball experiences vibration.

The present invention includes the following structural components:

an inflatable ball, constructed of multiple layers of material, with an embedding hole;

a power supply device, installed inside the ball through the embedding hole;

a switch, wired to the said power supply device, enabling the ball to be manually illuminated or automatically illuminated when the ball experiences vibration; and multiple output wires, connected to the above-mentioned switch and multiple light emitting elements. These light emitting elements are distributed over the surface of the ball, and receive power from the above-mentioned power supply device for illumination.

The inside of the ball contains a rubber holder in which the power supply device and the switch are installed.

The above-mentioned switch is composed of a manually operated device and a vibration-triggered device; the user can either directly switch on or shut off the light emitting elements by using the manual mode, or he can switch to the vibration-sensitive mode, in which when the ball experiences vibration, the switch is automatically turned on and power transmits from the battery to the output wires to light up the ball. On the other hand, when the ball returns to the static status, the vibration-triggered switch is shut off. The power supply device described here allows the user to easily replace a used up battery with a new one.

Further advantages, features and details of the present invention will be elucidated on the basis of the following description of a preferred embodiment thereof, with reference to the annexed figures.

DETAILED DESCRIPTION OF THE PREFERRED EMBODIMENT

The present invention provides an illuminating ball (200) in which a power supply device (100) is embedded. The power supply device (100) connects to multiple light emitting elements (62) via wires, where the light emitting elements (62) are distributed in an exposed manner on an exterior periphery of the ball (200). In one aspect, when the ball (200) experiences vibration such as when bouncing, a vibration-triggered switch (50) connecting to the power supply device (100) can be automatically conducted, whereby these light emitting elements (62) are activated. The vibration-triggered switch can be automatically turned off if the ball (200) is in the static status. In another aspect, these light emitting elements (62) also can be manually activated regardless of the status of the ball (200).

An inflatable ball such as a basketball is basically composed of an inner bladder, a winding string layer forming around the bladder, an intermediate layer formed around the winding string layer and a cover layer attached over the intermediate layer. The illuminating device disclosed in the present invention can be applied to any kind of inflatable ball.

Figure 1:
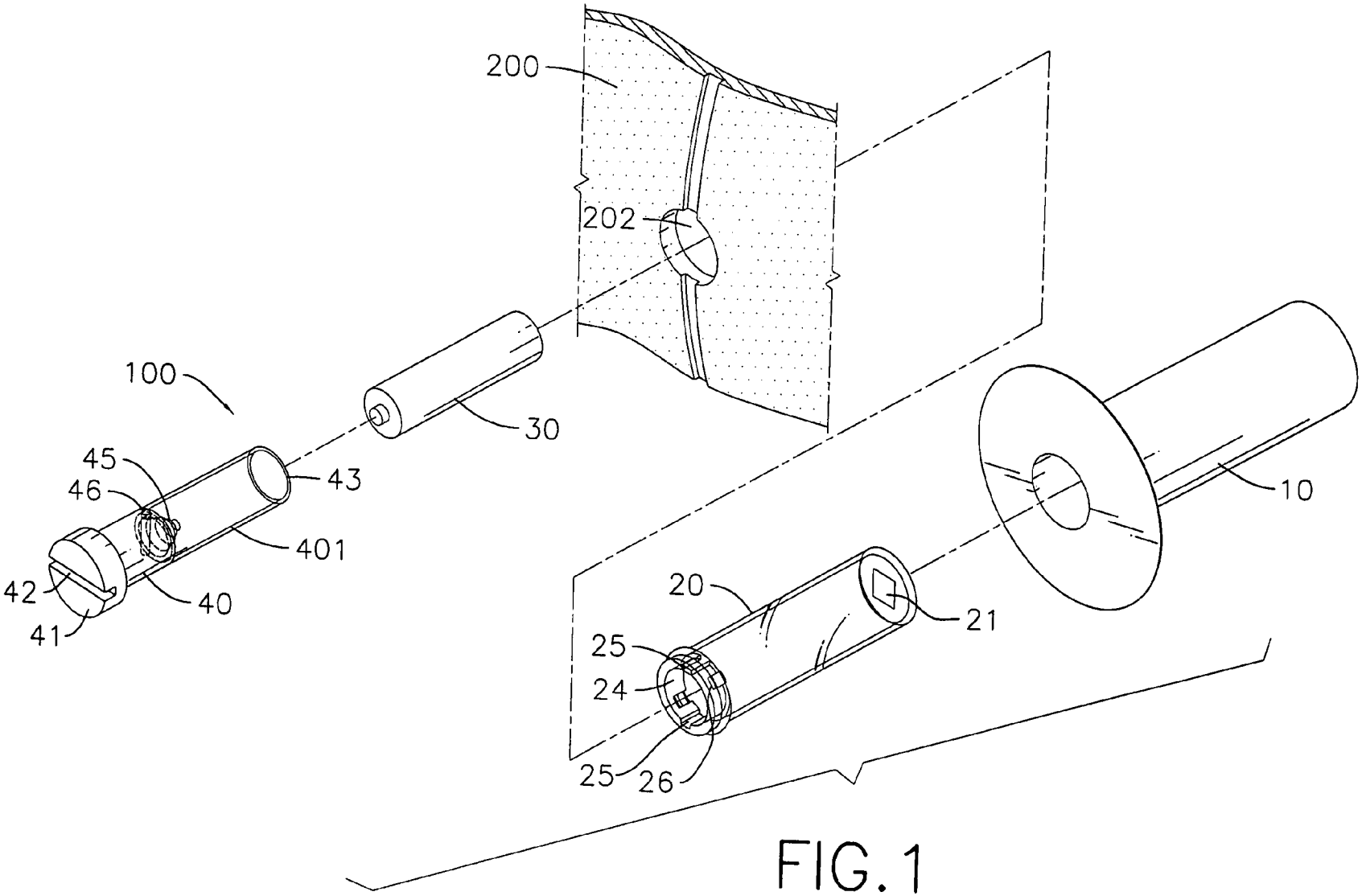
FIG. 1 is an exploded perspective view of a power supply device in the illuminating ball of the present invention.
Figure 2:
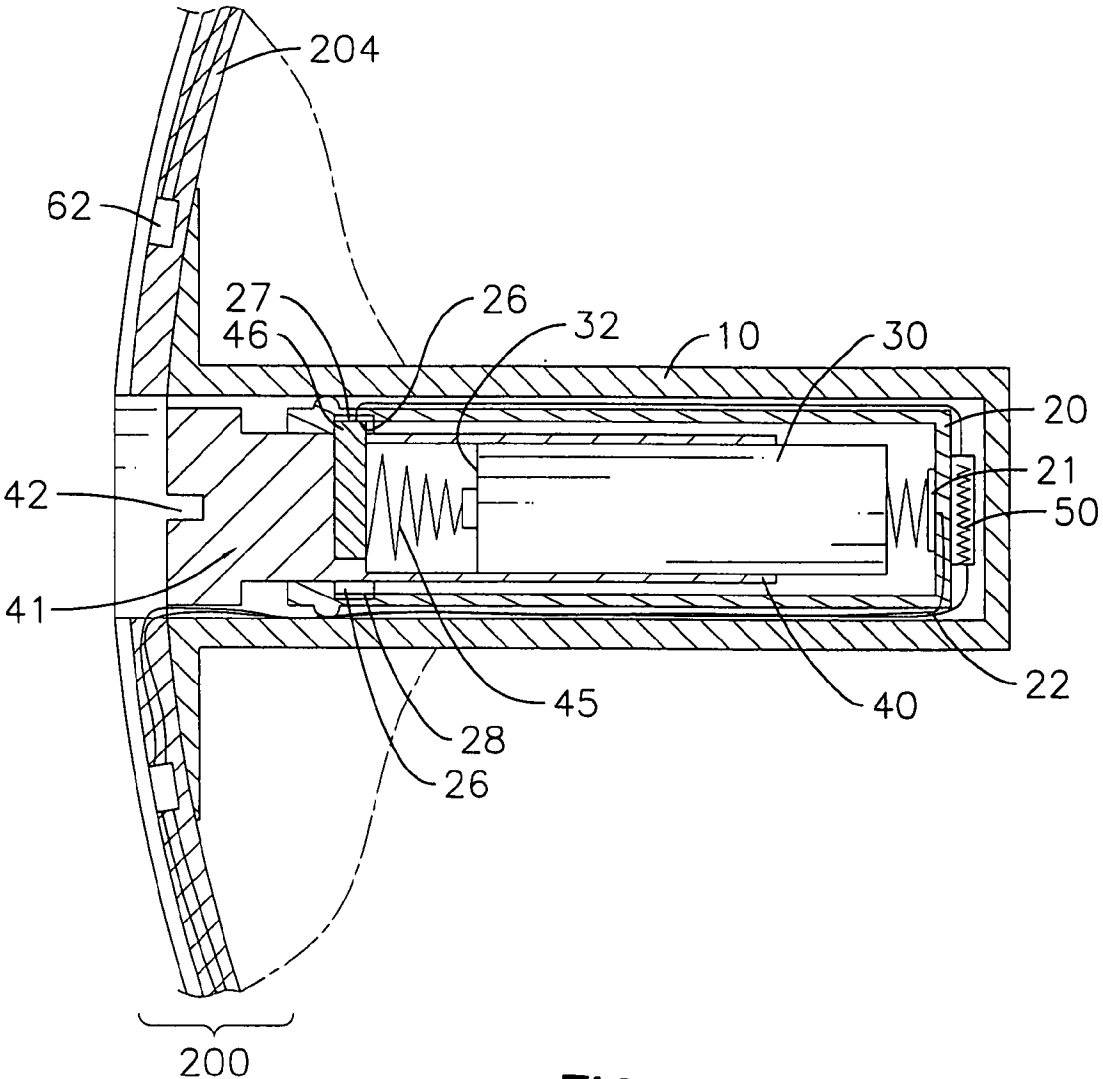
FIG. 2 is a cross-sectional view of the power supply device of FIG. 1.

With reference to FIGS. 1 and 2, a ball (200) (only a small portion of the ball is shown) having the above-mentioned multi-layer structure is defined with a hole (202). A rubber holder (10) for retaining a power supply device (100) therein is mounted inside the ball (200) and firmly fixed to the inner bladder. The rubber holder (10) is formed as a tube body with a tightly closed bottom and an opening at another end, where an integrated disk (not numbered) extends outward from the opening. The rubber holder (10) can be integrally molded with and attached to the inner bladder while the inner bladder is being manufactured. Since the bottom end of the tube body is tightly closed, escape of air from the ball is thus prevented. Furthermore, the disk abuts the interior periphery surrounding the respective hole in the bladder, thereby creating a large sealing surface.

The power supply device (100) retained in the rubber holder (10) comprises a battery holder (20), a battery (30) received in the battery holder (20) and a covering tube (40).

The battery holder (20) forms as a hollow column with an open top and a closed bottom. A bottom conductive plate (21) is secured on the inner bottom of the holder (20). A flange (24) is formed around the opening in the battery holder (20). Two gaps (25) are defined through the flange (24) and at opposed positions to separate the flange (24) into two semicircular segments. Two engaging notches (26) are defined on the flange (24) but not through it, wherein each notch (26) is adjacent to a respective one of the gaps (25). A first conductive pad (27) and a second conductive pad (28) are respectively formed on the inner wall of the two notches (26).

The battery (30) with an anode and a cathode is installed in the battery holder (20). The first end of the battery (30), for example the cathode, electrically contacts with the bottom conductive plate (21) of the battery holder (20). The second end of the battery (30), for example the anode, is for contacting with the covering tube (40) as discussed hereinafter.

The covering tube (40) is formed as a solid head portion and a sleeve (401) with a bottom opening (43) extending from the head portion. The battery (30) can be received in the hollow sleeve (401). An enlarged screw head (41) is integrally formed at one end of the head portion, where a slot (42) is defined on the screw head (41). A conducting spring (45) is mounted on the bottom surface of the head portion inside the sleeve (401) for contacting with the battery (30). A block (46) protrudes from the outer surface of the head portion and is electrically connected to the conducting spring (45). The electrical connection can be achieved by internal wires (not shown) or by metal conducting films attached on the outer surface of the covering tube (40).

When assembling the power supply device (100), the battery holder (20) is firstly installed into the rubber holder (10) and then the battery (30) is slid into the battery holder (20), whereby the anode of the battery (30) can contact with the bottom conductive plate (21). The covering tube (40) is inserted into the battery holder (20) to hold the battery (30), whereby the battery (30) can be received inside the sleeve (401) and its cathode is in contact with the conducting spring (45).

Figure 3:
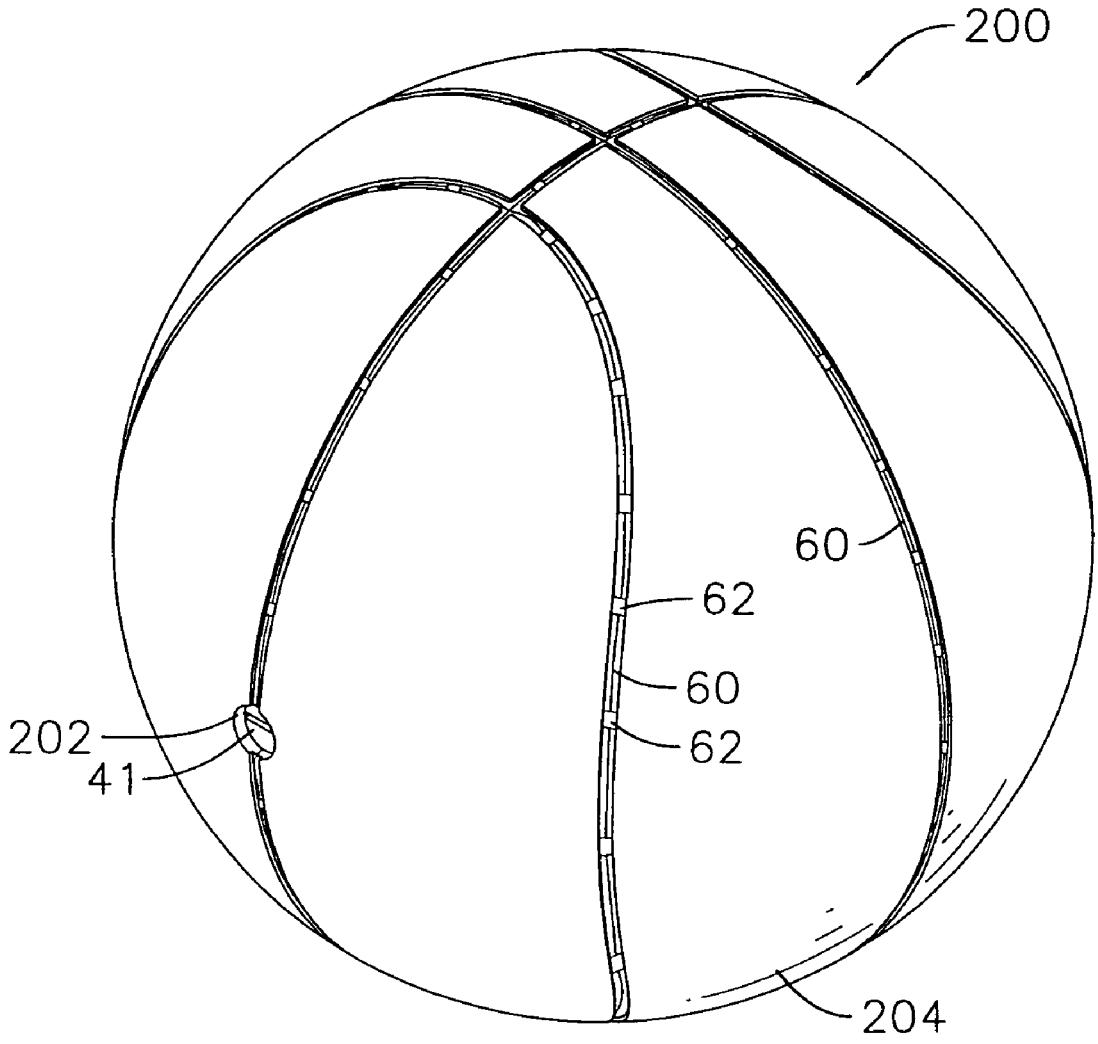
FIG. 3 is a perspective view showing an intermediate layer of the illuminating ball, wherein multiple light emitting elements are mounted on the intermediate layer.

With reference to FIGS. 2 and 3, a vibration-triggered switch (50) is mounted on the outer bottom surface of the battery holder (20). The switch (50) connects to the first conductive pad (27) and second conductive pad (28) via wires (22). The two conductive pads (27) (28) can connect to multiple light emitting elements (62) via output wires (60).

With reference to FIG. 3, the multiple output wires (60), which are connected to many light emitting elements (62), are mounted on the intermediate layer (204) of the ball (200) and preferably along the grooves of the intermediate layer (204). The light emitting elements (62) can be formed by light emitting diodes (LED).

Figure 4:
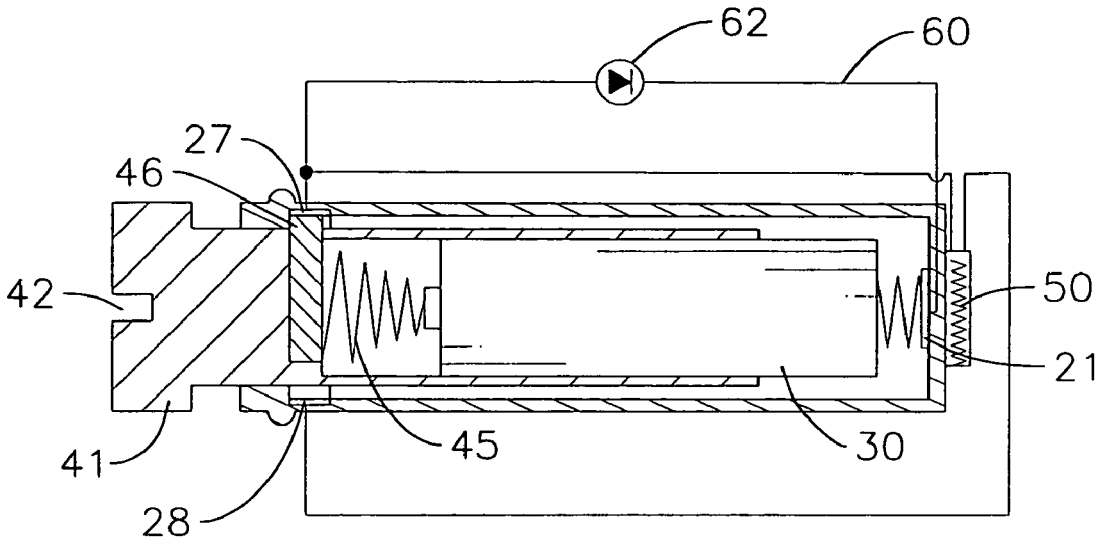
FIG. 4 is a cross-sectional view showing the light emitting elements being activated in a manual-controlled model.

With reference to FIG. 4, the covering tube (40) together with the battery holder (20) can serve as a manual switch to control the light emitting elements (62). When the conductive block (46) is retained in the first conductive pad (27), it forms a complete loop with the output wires (60) and lights up the light emitting elements (62) without having to go through the vibration-activated switch (50).

Figure 5:
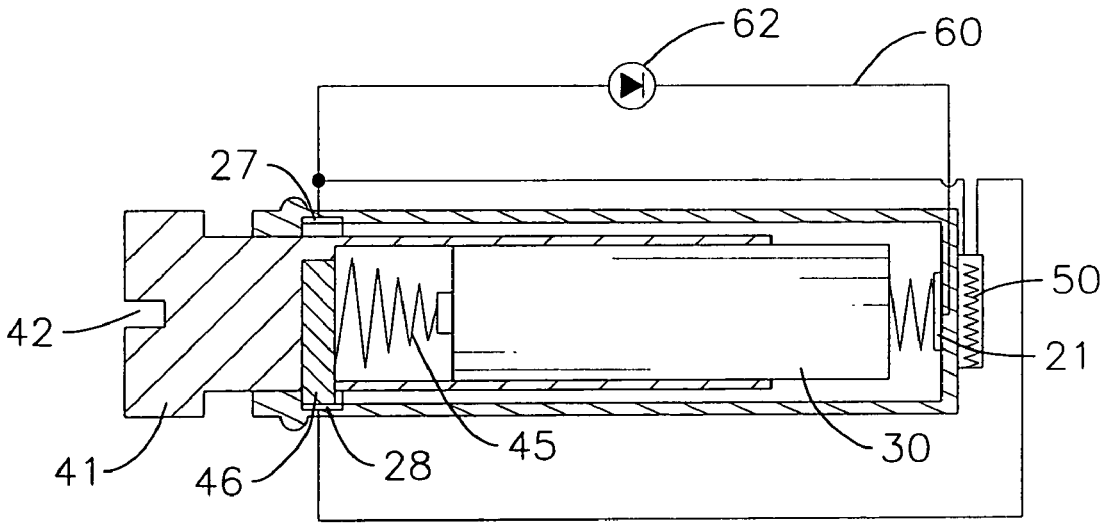
FIG. 5 is a cross-sectional view showing the light emitting elements being activated in a vibration-sensitive mode.

With reference to FIG. 5, in the vibration-sensitive mode, another loop is formed by the conductive block (46), the vibration switch (50), the light emitting elements (62) and the battery (30). When a user is playing the ball (200), the vibration-triggered switch (50) can be automatically turned on, allowing the battery (30) to supply a voltage to activate the light emitting elements (62) via the output wires (60). In another aspect, once the ball (200) returns to the static status, the switch (50) is turned off.

Figure 6:
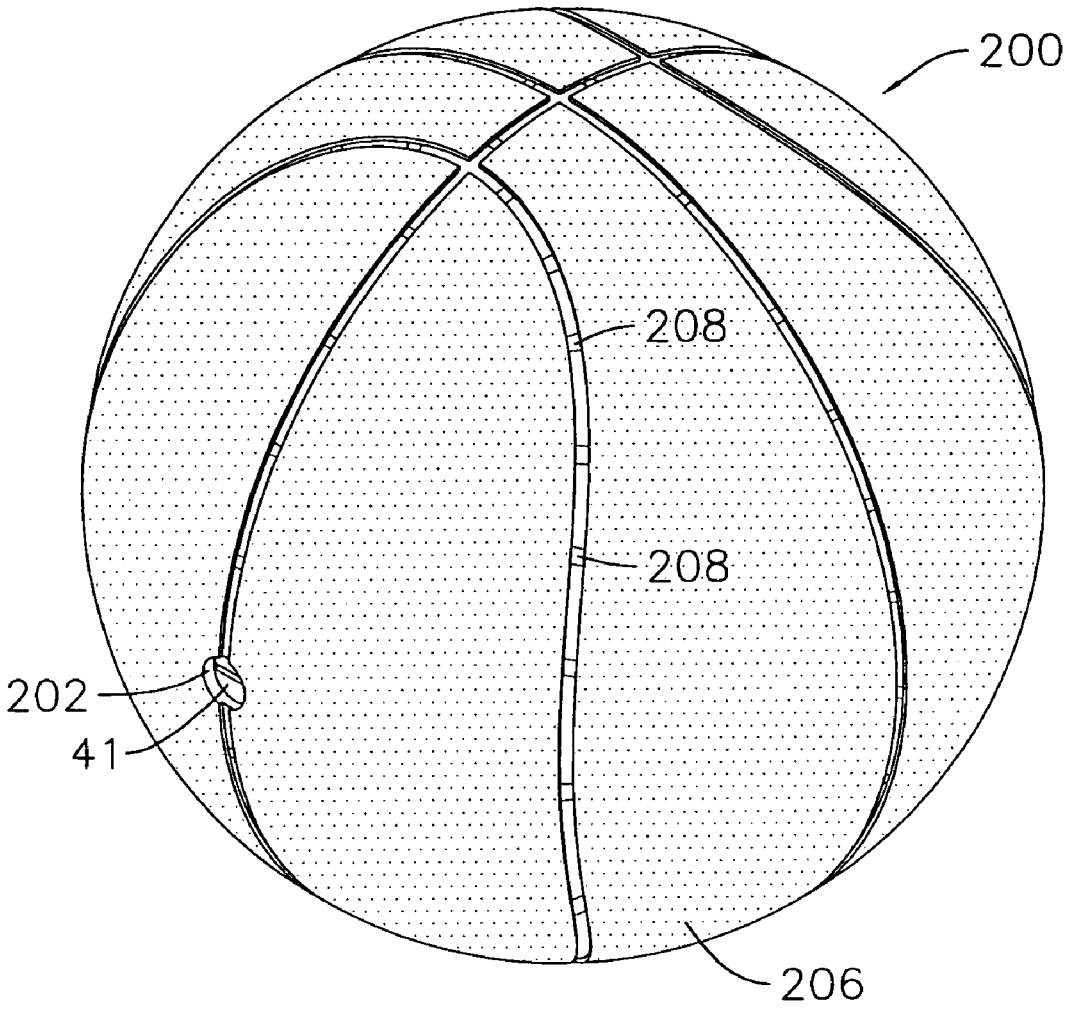
FIG. 6 is a perspective view of the illuminating ball, wherein a cover layer has been attached on the intermediate layer of FIG. 3.

With reference to FIG. 6, a cover layer (206) is further attached over the intermediate layer (204). Multiple light pervious holes (208) can be further defined on the cover (206) at positions corresponding to the light emitting elements (62). In another embodiment when the cover layer (206) is made of translucent or transparent material, the pervious holes (208) are not required.

The battery (30) in the power supply device (100) is replaceable if the power has been used up. A user can utilize hand tools or just his bare hands to do the job. Slightly pressing the screw head (41) inward into the battery holder (20), and slowly rotating the screw head (41) to a position where the conductive block (46) is in alignment with either the first or second gap (25). As the conducting spring (45) inside the covering tube (40) returns from the condensed status to the normal status, it releases forces that eject the covering tube (40) from the battery holder (20), enabling the user to easily remove the battery and replace it.

After a new battery has been put inside the battery holder (20), the covering tube (40) is inserted into the battery holder (20) by pressing and rotating the screw head (41) to the position where the block (46) is in alignment with either gap (25). When the block (46) enters the battery holder (20), further slightly rotating the screw head (41) can guide the block (46) to engage with the notch (26). The conducting spring (45) in the battery holder (20) enters into the condensed status and provides a counterforce against the bottom of the screw head (41) so that the block (46) can tightly abut the flange (24) to prevent the covering tube (40) from turning loose.

As described above, the present invention uses a simple power supply device (100) and light emitting elements (62) on a ball (200), so that the ball is illuminated when it experiences vibration. Compared with the conventional ball, the present invention greatly enhances the pleasure of a ball game. This new design has never been seen in similar fields of the art, thus fully meeting the patent requirements. This application is duly filed in accordance with patent regulations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illuminating ball, comprising:

an inflatable ball composed of multiple layers and having a hole;

a rubber tube attached to an inner surface of the ball and in alignment with the hole;

a power supply device that provides power, and being retained in the rubber tube, the power supply device comprising:

a battery holder formed as a hollow column with an open top and a closed bottom, a bottom conductive plate being mounted on the closed bottom, the battery holder including:

a flange formed around the open top, the flange having two opposed gaps defined therethrough, and two engaging notches defined on the flange but not through, each engaging notch being adjacent to a respective one of the gaps; and a first conductive pad and a second conductive pad respectively mounted in the two notches;

a battery received in the battery holder, a first end of the battery electrically contacting with the bottom conductive plate, a second end of the battery facing the open top of the battery holder; and a covering tube formed by a solid head portion and a sleeve with an opening, the sleeve extending from the head portion, a screw head being integrally formed on the head portion, and a conducting spring being mounted on a bottom surface of the head portion and electrically contacting to the second end of the battery, the covering tube including:

a slot defined on the screw head, and a conductive block protruding from an outer surface of the covering tube for engaging with one of the notches of the battery holder;

a vibration-triggered switch, connected to the power supply device and operating in one of a manual mode and a vibration-sensitive mode;

multiple output wires connected to the vibration-triggered switch; and multiple light emitting elements connected to the output wires and mounted on the ball wherein the first and second conductive pads are electrically connected to the vibration-triggered switch and the output wires, and wherein when the power supply device is operated in the vibration-sensitive mode, the vibration-triggered switch automatically turns on to activate the light emitting elements when the ball experiences vibration from impact with a surface.

2. The ball as claimed in claim 1, wherein the vibration-triggered switch is mounted on an outer bottom surface of the battery holder.

3. The ball as claimed in claim 2, further comprising an intermediate layer and a cover attached over the intermediate layer, the output wires and the light emitting elements being mounted on the intermediate layer and concealed by the cover.

4. The ball as claimed in claim 1, further comprising an intermediate layer and a cover attached over the intermediate layer, the output wires and the light emitting elements being mounted on the intermediate layer and concealed by the cover.

5. The ball (200) as claimed in claim 3, wherein multiple light pervious holes are defined on the cover at positions corresponding to the light emitting elements.

6. The ball (200) as claimed in claim 4, wherein multiple light pervious holes are defined on the cover at positions corresponding to the light emitting elements.

* * * * *